United States Patent [19]

Jungesjo

[11] 4,270,375

[45] Jun. 2, 1981

[54] FORMING MACHINE INCLUDING ROTARY DRIVE MECHANISM

[75] Inventor: Harald N. Jungesjo, Rochester, Mich.

[73] Assignee: Anderson-Cook, Inc., Fraser, Mich.

[21] Appl. No.: 56,362

[22] Filed: Jul. 10, 1979

[51] Int. Cl.[3] ..... B21C 37/30; B21D 53/28

[52] U.S. Cl. ..... 72/88

[58] Field of Search ..... 72/88, 90

[56] References Cited

U.S. PATENT DOCUMENTS

| | | | |
|---|---|---|---|
| 319,752 | 6/1885 | Simonds | 72/88 |
| 2,995,964 | 8/1961 | Drader | 72/88 |
| 3,793,866 | 2/1974 | Anderson et al. | 72/88 |
| 3,982,415 | 9/1976 | Killop | 72/88 |
| 4,028,922 | 6/1977 | Killop | 72/88 |
| 4,045,988 | 9/1977 | Anderson | 72/108 |
| 4,080,699 | 3/1978 | Anderson | 72/88 |
| 4,155,237 | 5/1979 | Jungesjo | 72/88 |

*Primary Examiner*—Milton S. Mehr

*Attorney, Agent, or Firm*—Reising, Ethington, Barnard, Perry & Brooks

[57] ABSTRACT

A forming machine (10) is disclosed as including a rotary drive mechanism (30) that provides accurate control of the degree to which forming is performed. The drive mechanism includes a pair of drive members (34) mounted for movement with a pair of elongated dies that are preferably embodied as die racks (22, 24) mounted on lower and upper bases (12, 14) of the machine. A toothed drive gear (32) is meshed with drive teeth (52) on each of the drive members and is rotatably driven by a drive spindle to thereby move the drive members and hence the dies in order to form a workpiece mounted between the dies. The drive mechanism has particular utility in a machine for forming a thin-walled annular sleeve of a workpiece mounted on a toothed mandrel (38) between the dies. An automatic loader is preferably utilized to mount the workpiece on the mandrel such that movement of the dies engages the die and mandrel teeth with the workpiece sleeve therebetween in order to provide the forming.

7 Claims, 5 Drawing Figures

FORMING MACHINE INCLUDING ROTARY DRIVE MECHANISM

TECHNICAL FIELD

The present invention relates generally to forming machines and, more particularly, to a forming machine including a rotary drive mechanism for moving a pair of elongated forming dies between an end-to-end relationship and an overlapping relationship.

BACKGROUND ART

Prior art forming machines include a pair of forming dies mounted for movement between an end-to-end relationship and an overlapping relationship such that forming faces thereof engage a workpiece supported between the dies in order to provide forming of the workpiece. Usually the elongated dies are in the form of rectilinear die racks which are slidably mounted on upper and lower machine bases that define a work space forward of a rear connecting portion extending between the bases. See for example, U.S. Pat. Nos. 2,995,964 and 3,793,866, the latter one of which is assigned to the assignee of the present invention. However, it is also possible to have the elongated dies mounted on rotary spindles such that partially circular forming faces thereof form a workpiece mounted between the spindles in the manner disclosed by U.S. Pat. No. 4,045,988 which is also assigned to the assignee of the present invention.

In the prior art machines of the above described type, the dies are separately driven by a pair of drive motors whose driving action is coordinated by one or more gears in order to insure an equal extent of movement of each die. Hydraulic piston and cylinder units function as the drive motors for the machine of the U.S. Pat. No. 2,995,964 and the driving movement of forming die racks upon piston rod retraction and extension is coordinated by a gear that is meshed with a pair of coordinating racks in order to insure an equal extent of movement of each forming die rack. Rotary hydraulic motors are utilized in the machine of the U.S. Pat. No. 3,793,866 in order to drive the forming die racks and are interconnected by a gear train that insures an equal extent of movement of each forming die rack. Likewise, the elongated dies of the rotary forming machine of the U.S. Pat. No. 4,045,988 are also driven by a pair of hydraulic motors whose driving operation is interconnected by a gear train. With such types of machines, a small amount of backlash that may be present with the coordinating gearing can permit one of the dies or die racks to continue to move a very small distance on the order of one or several thousandths of an inch, after the other die or die rack has already stopped moving.

Solid workpieces are usually formed by the type of machine described above to include gear teeth or splines and, once forming has been performed over the complete circumference of the workpiece, the formed teeth or splines also help to coordinate the movement of the forming dies or racks. Formed teeth or splines on solid workpieces usually have the requisite strength to provide the coordination between the driving movement of the associated pair of dies or die racks due to the solid nature of the teeth or splines.

U.S. Pat. Nos. 3,982,415 and 4,028,922, both of which are assigned to the assignee of the present invention, disclose forming machines and dies thereof that are capable of forming splines or teeth in a thin-walled annular sleeve of a workpiece. This type of forming is particularly useful for forming power transmission members such as splined clutch hubs used for vehicle automatic transmissions. Forming begins by mounting of the workpiece with its sleeve positioned over a toothed mandrel located between the dies which are positioned in an end-to-end relationship. Movement of the dies from the end-to-end relationship into an overlapping relationship meshes the die and mandrel teeth with the sleeve of the workpiece located therebetween so as to provide forming of the splines or teeth on the sleeve. It has been found that forming of such thin-walled sleeves requires an accurate control of the extent of die movement in order to provide sleeves whose formed splines or teeth are of a precise shape without any out of roundness. In this connection, reference should be made to the U.S. Pat. No. 4,028,922 which discloses a die tooth pattern and forming process for preventing out of roundness on the formed sleeve. Also, it is very important that the dies move in a precisely coordinate manner whose extent of movement is accurately controlled so that the forming terminates immediately after all of the splines or teeth have been formed in order to prevent deformation of the formed teeth or splines by continued movement of one or both dies.

DISCLOSURE OF INVENTION

An object of the present invention is to provide a forming machine having an improved rotary drive mechanism for accurately controlling the degree of driving movement of a pair of elongated dies between an end-to-end relationship and an overlapping relationship in order to provide precise forming of workpieces.

Another object of the invention is to provide a forming machine including an improved rotary drive mechanism for accurately controlling the degree of driving movement of a pair of dies whose teeth engage a thin-walled annular sleeve of a workpiece mounted on a toothed mandrel between the dies such that meshing of the die and mandrel teeth with the sleeve therebetween provides forming of the sleeve.

In carrying out the above objects, a forming machine constructed in accordance with the invention includes a rotary drive mechanism that is used to drive a pair of elongated forming dies which are mounted for movement between an end-to-end relationship and an overlapping relationship. Forming faces of the dies oppose each other upon movement into the overlapping relationship so as to engage opposite sides of a workpiece supported therebetween in order to provide forming of the workpiece. A pair of drive members of the drive mechanism are respectively mounted for movement with the pair of elongated dies and have drive teeth spaced alongside the elongated length of the dies. A toothed drive gear is meshed with the drive teeth on each of the drive members and is driven by a rotary drive spindle that provides the impetus for rotating the drive gear to thereby move the drive members and hence the dies in order to form a workpiece mounted between the dies.

Accurate control of the extent of die movement is possible with a machine having the rotary drive mechanism described above since both dies are driven from a common drive spindle. It is important to note that the drive gear that drives the drive members in order to move the dies does not merely coordinate die movement as is the case with the prior art machines of this type. Rather, as previously stated, the drive gear transfers the impetus for moving the drive members through a single torque path so as to insure that each die terminates movement at the same time as the other die after moving an accurately controlled distance.

The machine incorporating the drive mechanism preferably is of the type including upper and lower bases defining a work space therebetween and also including a connecting portion that extends between the bases at the rear of the work space. A pair of elongated die racks embody the dies and are respectively mounted on the upper and lower bases for rectilinear movement between the end-to-end relationship and the overlapping relationship. Each die rack has a straight forming face on which teeth are spaced so as to engage a rotatably supported workpiece as the die racks move into the overlapping relationship. Driving of the drive gear is provided by a gear reduction unit having an output that rotatably drives the drive spindle which is coupled to the drive gear. A rotary drive motor that is preferably of the hydraulic type drives an input of the gear reduction unit in order to provide the drive spindle rotation and hence the movement of the die racks that provides the workpiece forming.

Forming machines constructed according to the invention with the rotary drive mechanism have particular utility for forming thin-walled annular sleeves of workpieces. A toothed mandrel rotatably mounted on the drive gear at a location between the dies receives and thereby rotatably supports a thin-walled annular sleeve of the workpiece on which the forming is to take place. The pair of drive members respectively mounted for movement with the pair of elongated dies of the machine are driven by the toothed drive gear which is rotatably supported coaxial with the mandrel on the rotary drive spindle. Rotary driving of the spindle provides the impetus for rotating the drive gear to move the drive members and hence the dies in order to mesh the die and mandrel teeth with the thin-walled sleeve of the workpiece therebetween so as to thereby form the workpiece sleeve by the die and mandrel teeth.

The sleeve forming version of the machine preferably has a pair of elongated die racks respectively mounted on upper and lower bases for rectilinear movement between the end-to-end relationship and the overlapping relationship. The toothed mandrel is located in the work space between the bases which are connected by a connecting portion at the rear of the work space. The rotary drive spindle that rotates the drive gear in order to drive the die racks is driven by the output of the gear reduction unit whose input is driven by the rotary drive motor which is preferably of the hydraulic type. The drive spindle has an elongated shape including a driven end that is driven by the output of the gear reduction unit and a driving end that drives the drive gear. A loader for mounting and removing workpieces from the toothed mandrel includes an axially movable unloading member that extends through aligned central openings in the mandrel, the drive gear, and the drive spindle. Axial movement of the unloading member and axial movement of a loading member under the control of associated hydraulic cylinder provides automatic loading and unloading of the workpieces on the mandrel.

The objects, features, and advantages of the present invention are readily apparent from the following description of the best mode for carrying out the invention when taken in connection with the accompanying drawings.

BEST MODE FOR CARRYING OUT THE INVENTION

Figure 1:
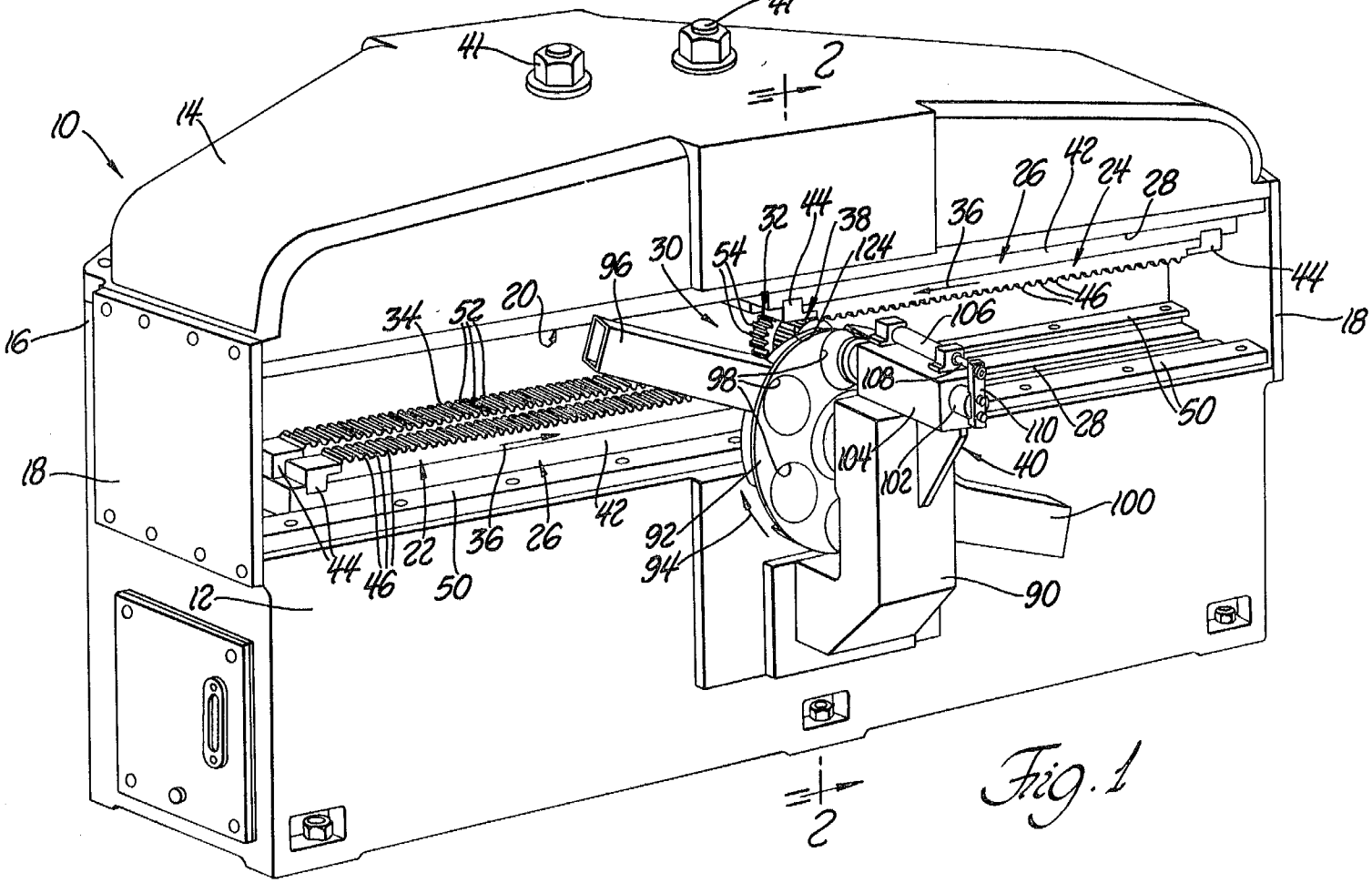
FIG. 1 is a perspective view of a forming machine that includes a rotary drive mechanism in accordance with the present invention, and FIGS. 2A, 2B, 2C, and 2D arranged alphabetically from the right toward the left collectively illustrate a partially sectioned view of the machine taken along line 2—2 of FIG. 1.

Referring to FIG. 1, a machine constructed in accordance with the present invention is generally indicated by reference numeral 10 and includes a lower base 12 that is mounted on the floor and an upper base 14 mounted on the lower base by a rear connecting portion 16 and a pair of end plates 18. Lower and upper bases 12 and 14 cooperate to define a work space 20 forward of the rear connecting portion 16. A pair of lower and upper forming dies in the form of straight die racks 22 and 24 are respectively mounted on associated slides 26 which are supported by upper and lower slideways 28 of the lower and upper bases. A rotary drive mechanism collectively indicated by 30 includes a toothed drive gear 32 that is meshed with lower and upper drive members 34 (only one shown) in order to provide movement of the die racks 22 and 24 in the opposite directions of arrows 36 from the end-to-end position shown into an overlapping relationship so as to provide forming of a workpiece in a manner which is hereinafter described. As shown, the machine includes a toothed mandrel 38 that receives a thin-walled annular sleeve of a workpiece to be formed from an automatic loader 40 which also removes the workpiece after the forming. A pair of deflection control connections 41 extend between the lower and upper bases 12 and 14 in order to limit the degree of vertical deflection therebetween as the forming takes place.

Figure 2A:
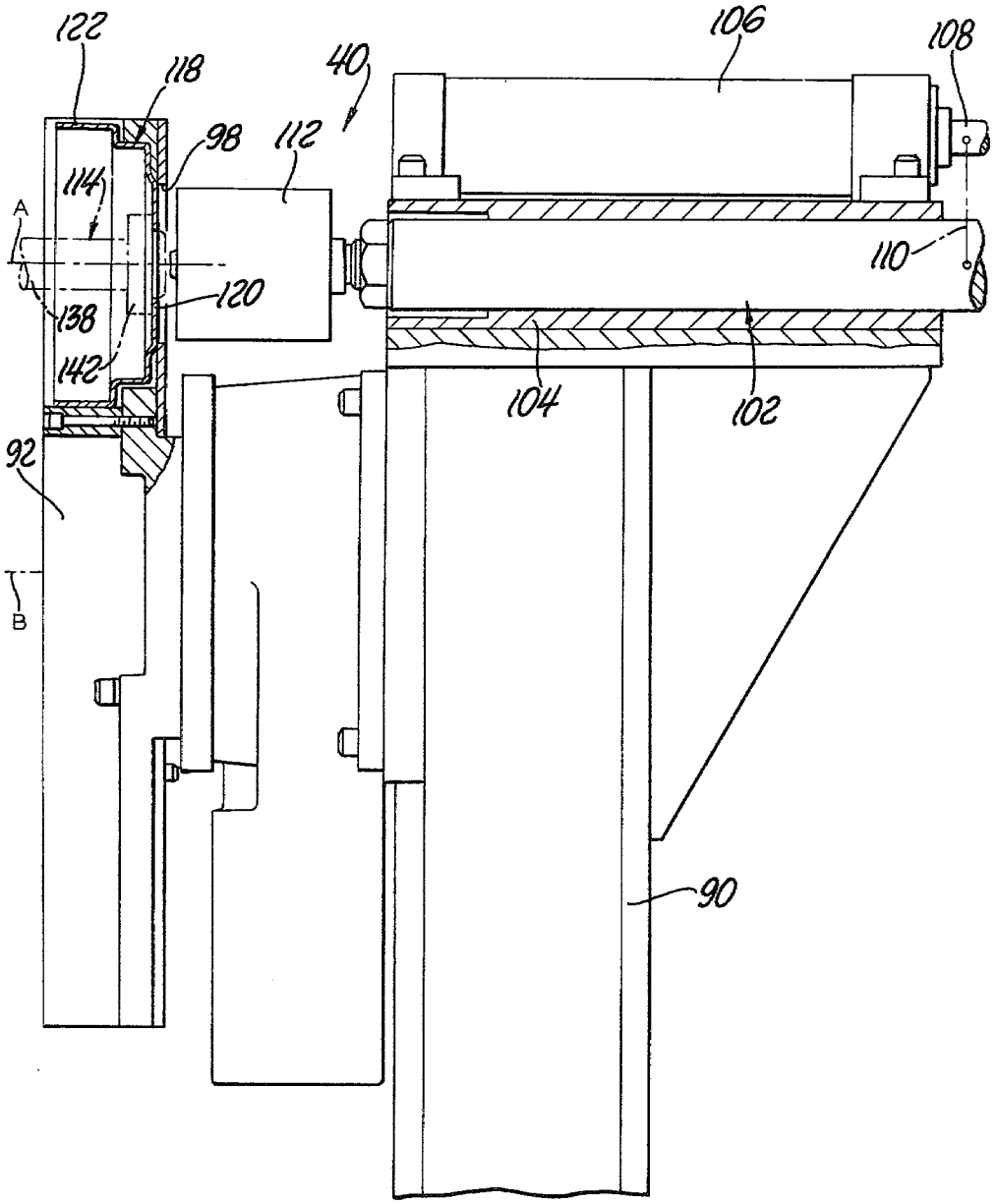
Figure 2B:
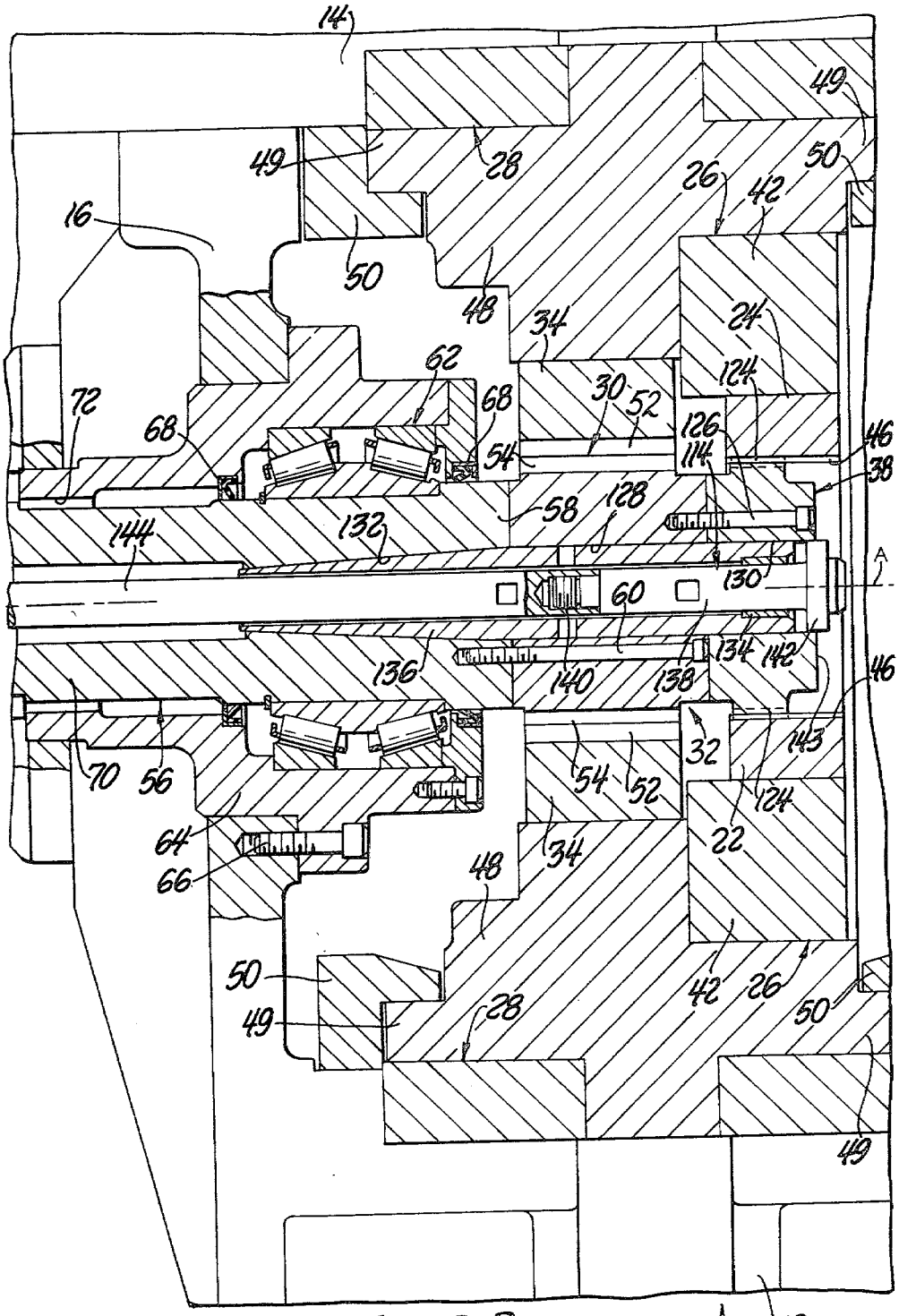

As seen in FIG. 2B, each of the lower and upper die racks 22 and 24 is mounted on a slide member 42 of the associated slide 26. Flanged end mounts 44 seen in FIG. 1 secure the ends of the die racks 22 and 24 to the slide members 42. Forming teeth 46 of each die rack 22 and 24 are spaced along the length thereof between the mounts 44 to provide workpiece forming during operation of the machine. A main slide member 48 (FIG. 2B) of each slide 26 is slidably mounted on the associated slideway 28 and has flanges 49 slidably engaged by elongated retainers 50 that are secured to the associated machine base by a number of bolts. Any suitable means such as bolts secure the slide members 42 to the associated main slide members 48. The pair of drive members 34 are respectively secured to the main slide members 48 by flanged end mounts 44 (FIG. 1) in the same manner the die racks 22 and 24 are secured to the slide members 42. Each drive member 34 is thus mounted for movement with the associated die rack 22 or 24. Drive teeth 52 of the drive members 34 are spaced along their lengths alongside the forming faces provided by the forming teeth 46 of the die racks. Drive teeth 52 are meshed with drive teeth 54 on the drive gear 32 which is supported along an axis A by a rotary drive spindle 56 that provides the impetus for rotating the drive gear. Such rotation meshes the teeth 54 of the drive gear with the teeth 52 on the drive members 34 in order to move the die racks 22 and 24 from the end-to-end relationship of FIG. 1 along the direction of arrows 36 into the overlapping relationship where the forming faces defined by the forming teeth 46 on the die racks oppose each other. As such movement takes place, the forming teeth 46 engage a workpiece mounted on the toothed mandrel 38 in order to provide forming of the workpiece.

Figure 2C:
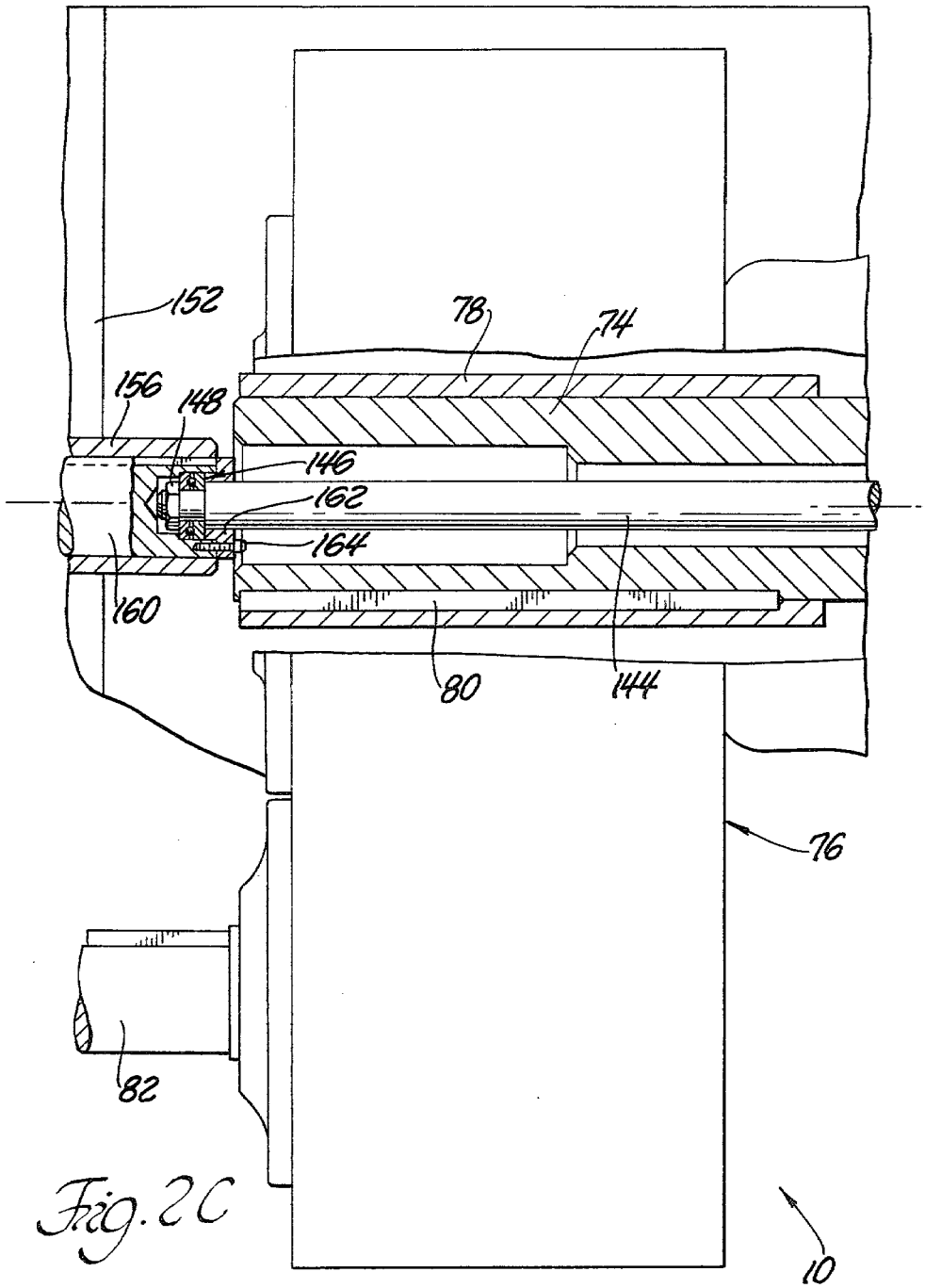
Figure 2D:
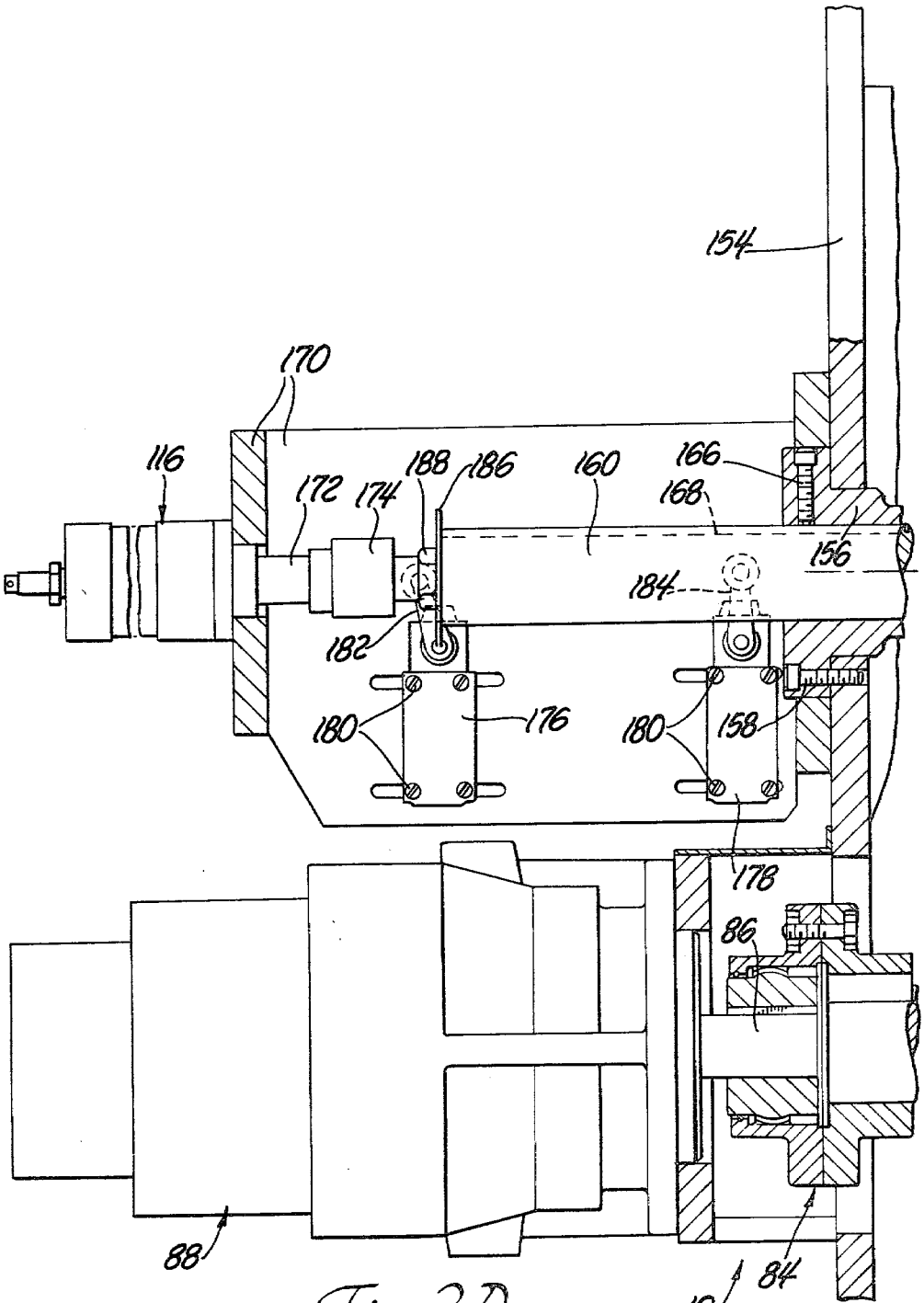

As seen by combined reference to FIGS. 2B, 2C, and 2D, rotary drive spindle 56 has a forward driving end 58 on which the drive gear 32 is mounted by a plurality of bolts 60, only one of which is shown. A dual row anti-friction roller bearing 62 of the tapered type rotatably supports the driving end 58 of spindle 56 on a housing 64 that is secured to the base connecting portion 16 by a number of bolts 66, only one shown. A pair of seals 68 on the housing 64 are located at opposite axial sides of the bearing 62 and slidably engage the outer surface of the spindle 56 to seal the bearing. Drive spindle 56 has an elongated shape and includes an intermediate portion 70 that extends rearwardly through an opening 72 in the housing 64 to its rearward driven end 74. Driving of spindle 56 is accomplished through a gear reduction unit 76 whose output is in the form of a sleeve 78 that is rotatably coupled by a key 80 to the driven spindle end 74. An input of gear reduction unit 76 takes the form of a shaft 82 that is driven by a coupling 84 (FIG. 2D) on the output shaft 86 of a rotary drive motor 88 that is preferably of the hydraulic type. Operation of the drive motor 88 thus drives the gear reduction unit 76 in order to rotate the drive spindle 56 to provide forming of a workpiece by die rack movement in the manner previously described.

With reference to FIG. 1, the loader 40 includes a somewhat J-shaped support 90 whose lower end is secured to the front side of the floor mounted machine base 12 and whose upper end is spaced from this machine base so as to rotatably support a load table 92 that is rotated in the direction of arrow 94 by a suitable drive that is not shown. An input chute 96 of the loader is fed workpieces to be formed from a suitable hopper or the like and has an inclined orientation so that the workpieces roll into openings 98 of table 92. Rotation of load table 92 in the direction of arrow 94 after each machine cycle aligns the opening 98 that has just received a workpiece with the toothed mandrel 38 and also feeds a previously formed workpiece into alignment with an output chute 100 whose inclined orientation allows the formed workpiece to roll downwardly into a suitable storage bin. A loading member 102 of loader 40 is mounted by a housing 104 on the upper end of support 90 and is moved by a hydraulic cylinder 106 in order to provide loading and unloading of workpieces on the mandrel 38 in a manner which is more fully hereinafter described. Cylinder 106 includes a piston connecting rod 108 that is secured to the loading member 102 by a connection 110. Extension and retraction of the cylinder rod 108 thus moves the loading member 102 toward and away from the toothed mandrel 98 along its axis of rotation.

As seen by reference to FIGS. 2A and 2B, loading member 102 is slidably movable along the axis A along which the toothed drive gear 32 and the toothed mandrel 38 are rotatably suppored for coaxial rotation with each other. The left end of unloading member 102 rotatably supports a clamp 112 that is aligned with the adjacent opening 98 in the load table 92 whose axis of rotation B on support 90 is located below the axis of spindle rotation A. An unloading member 114 that is operated by a hydraulic cylinder 116 (FIG. 2D) is slidably supported along the axis of mandrel rotation A in a manner than is hereinafter described and cooperates with the rotatable clamp 112 of the loading member 102 to move a workpiece 118 from the load table 92 for mounting on the toothed mandrel 38 in preparation for a forming operation. Workpiece 118 includes a radially extending end wall 120 of an annular shape that is clamped between the axial end of mandrel 38 and the rotatable clamp 112 on the loading member 102 during forming performed by the machine. A thin-walled annular sleeve 122 of workpiece 118 extends from end wall 120 and is positioned over teeth 124 of mandrel 38 upon mounting of the workpiece on the mandrel.

Referring to FIG. 2B, the toothed mandrel 38 is fixedly secured by a plurality of circumferentially spaced bolts 126 (only one shown) to the toothed drive gear 32 for rotational movement about axis A. Central openings 128 and 130 in the drive gear and the mandrel are aligned with a central opening 132 through the rotary drive spindle 56 along the axis of rotation A. Unloading member 114 is received within the openings 128, 130, and 132 and is supported by a bushing 134 of a sleeve 136 for axial movement along the direction of axis A. Sleeve 136 is press fitted into the tapered shape at the left end of the spindle opening 132. Unloading member 114 includes a right end 138 that is secured by a threaded connection 140 and has an annular end flange 142 that engages the end wall 120 (FIG. 2A) of the workpiece during mounting thereof on the toothed mandrel 38 and during removal from the mandrel after forming has been performed. During the forming, the flange 142 is positioned within the mandrel opening 130 so that the workpiece end wall 120 is clamped between the rotatable clamp 112 and the axial end surface 143 of the mandrel. Unloading member 114 includes a shaft 144 that extends rearwardly from the threaded connection 140 through the drive spindle opening 132 to an anti-friction thrust bearing 146 (FIG. 2C) that is retained by a nut 148 to the unloading member.

As seen by combined reference to FIGS. 2C and 2D, machine 10 includes base walls 152 and 154 on which a housing sleeve 156 is supported and secured by bolts 158 (only one shown) to slidably support a connector 160 whose right end includes a bearing retainer 162 that is secured by a number of bolts 164, only one of which is shown. Bearing 146 allows the connector 160 to move the unloading member shaft 144 to the right and the left while permitting the shaft to rotate without any accompanying rotation of the connector. An end of a bolt 166 threaded into sleeve 156 is received within an axial slot 168 of connector 160 to prevent the connector from rotating during axial movement provided by the hydraulic cylinder 116 which is mounted on the base wall 154 by a welded plate mount 170. A piston connecting rod 172 of cylinder 116 is secured by a coupling 174 to the left end of the connector 160 in order to provide axial movement of the connector 160 and hence the unloading member 114 during piston rod extension and retraction.

As seen in FIG. 2D, limit valves 176 and 178 are supported on the mount 170 by adjustable bolt and slot connections 180. Actuators 182 and 184 of the valves 176 and 178, respectively, are engaged by a tripper 186 that is secured on the left end of connector 160 by a nut 188 through whose interior the coupling 174 extends to be secured to the connector. Cooperation between the valves 176 and 178 controls the extent of extending and retracting movement of the cylinder 116 during loading and unloading of a workpiece on the toothed mandrel 38. Similar valves and actuators and an associated tripper control the extending and retracting movement of the hydraulic cylinder 106 that is connected to the loading member 102 as shown in FIG. 2A to provide its axial movement during mounting and removal of the workpiece 118 on the tooth mandrel.

Extension and retraction of the loading member 102 and unloading member 114 shown in FIGS. 2A and B under the control of their associated hydraulic cylinders previously described moves a workpiece 118 from the load table 92 along the axis of rotation A onto the toothed mandrel 38 so that the workpiece sleeve 122 is positioned over the mandrel teeth 124. The end wall 120 of the workpiece is engaged by the rotatable clamp 112 of the loading member and the flange 142 of the unloading member in a clamping relationship to hold and move the workpiece. After the workpiece is mounted, the hydraulic rotary drive motor 88 shown in FIG. 2D is actuated to drive the gear reduction unit 76 shown in FIG. 2C and thereby rotate the drive spindle 56 which in turn meshes the drive gear 32 with the drive members 34 in order to move the die racks 22 and 24 from their end-to-end relationship in opposite directions as shown by arrows 36 in FIG. 1. Meshing of the die rack teeth 46 and the mandrel teeth 124 with the workpiece sleeve 122 therebetween then provides forming of the workpiece sleeve to define axially extending teeth or splines along the length of the sleeve. During the forming, the rotatable clamp 112 on the loading member 102 and the axial surface 143 on the toothed mandrel 38 cooperate to clamp the workpiece end wall 120 in order to prevent any axial movement. The degree to which the die racks 22 and 24 are moved can be accurately controlled due to the manner in which the die racks are driven by the single rotary drive spindle 56 through the drive gear 32 and the associated drive members 34. The direction of driving by hydraulic motor 88 is reversed to return the die racks to their original positions after the forming.

After forming of a workpiece has been completed in the manner described above, loading member 102 shown in FIG. 2A and unloading member 114 shown in FIG. 2B are both moved by their associated hydraulic cylinders to clamp and then move the formed workpiece from the toothed mandrel 38 back to the loading table 92. Movement of the loading member 102 and the unloading member 114 in opposite directions away from each other then allows the loading table 92 to be rotated in order to position another workpiece to be formed along the axis of rotation. Subsequent movement of the loading member 102 and the unloading members 114 toward each other then engages the rotatable clamp 112 and the flange 142 with the next workpiece to be formed ready for movement onto the toothed mandrel 38 in the manner previously described.

In connection with the type of tooth forming that takes place on the thin-walled workpiece, reference should be made to U.S. Pat. Nos. 3,982,415 and 4,028,922, both of which are assigned to the assignee of the present invention and hereby incorporated by reference. Also, in connection with the workpiece loader, reference should be made to U.S. Pat. No. 4,155,237 which issued on May 22, 1979 to the assignee of the present invention, and which is hereby incorporated by reference.

While the best mode for carrying out the invention has herein been described in detail, those familiar with the art to which this invention relates will recognize various alternative ways of practicing the invention as defined by the following claims.

I claim:

1. In a forming machine including a pair of elongated forming dies mounted for movement between an end-to-end relationship and an overlapping relationship and having respective forming faces that oppose each other upon movement into the overlapping relationship, and a workpiece support for rotatably mounting a workpiece between the dies so as to be formed by the forming faces thereof upon movement of the dies from the end-to-end relationship into the overlapping relationship, a rotary drive mechanism for the dies comprising: a pair of drive members respectively mounted for movement with the pair of elongated dies; each drive member having drive teeth spaced alongside the elongated length of the associated die; a toothed drive gear meshed with the drive teeth on both of the drive members; and a rotary drive spindle directly coupled to the drive gear to move the drive members and the dies under the impetus of driving torque transmitted through the drive gear to thereby form a workpiece mounted between the dies.

2. In a forming machine including upper and lower bases defining a work space therebetween and a connecting portion that extends between the bases, a pair of elongated die racks respectively mounted on the upper and lower bases for rectilinear movement between an end-to-end relationship and an overlapping relationship, each die rack having a toothed forming face that opposes the forming face of the other die rack upon movement into the overlapping relationship, and a workpiece support for rotatably mounting a workpiece between the die racks so as to be formed by the forming faces thereof upon movement of the die racks from the end-to-end relationship into the overlapping relationship, a rotary drive mechanism for the die racks comprising: a pair of elongated drive members respectively mounted on the upper and lower bases for rectilinear movement with the pair of elongated die racks; each drive member having drive teeth spaced along the elongated length thereof; a toothed drive gear located between the upper and lower bases and meshed with the drive teeth on both of the drive members; and a rotary drive spindle directly coupled to the drive gear to move the drive members and the die racks under the impetus of driving torque transmitted through the drive gear to thereby form a workpiece mounted between the die racks.

3. In a forming machine including upper and lower bases defining a work space therebetween and a connecting portion that extends between the bases, a pair of elongated die racks respectively mounted on the upper and lower bases for rectilinear movement between an end-to-end relationship and an overlapping relationship, each die rack having a toothed forming face that opposes the forming face of the other die rack upon movement into the overlapping relationship, and a workpiece support for rotatably mounting a workpiece between the die racks so as to be formed by the forming faces thereof upon movement of the die racks from the end-to-end relationship into the overlapping relationship, a rotary drive mechanism for the die racks comprising: a pair of elongated drive members respectively mounted on the upper and lower bases for rectilinear movement with the pair of elongated die racks; each drive member having drive teeth spaced along the elongated length thereof; a toothed drive gear located between the upper and lower bases and meshed with the drive teeth on each of the drive members; a rotary drive spindle that provides the impetus for rotating the drive gear to thereby move the drive members and hence the die racks in order to form a workpiece mounted between the die racks; a gear reduction unit having an input and also having an output that rotatively drives the drive spindle; and a rotary drive motor that rotatively drives the input of the gear reduction unit.

4. In a forming machine including a pair of elongated forming dies mounted for movement between an end-to-end relationship and an overlapping relationship, each die having a toothed forming face that opposes the forming face of the other die upon movement into the overlapping relationship, and a toothed mandrel that is rotatably mounted to receive and rotatably support a thin-walled annular sleeve of a workpiece between the dies for forming of the sleeve upon movement of the dies from the end-to-end relationship into the overlapping relationship, a rotary drive mechanism for the dies comprising: a pair of drive members respectively mounted for movement with the pair of elongated dies; each drive member having drive teeth spaced alongside the elongated length of the associated die; a toothed drive gear rotatably supported coaxial with the mandrel and meshed with the drive teeth on both of the drive members; and a rotary drive spindle directly coupled to the drive gear to move the drive members and the dies under the impetus of driving torque transmitted through the drive gear to mesh the die and mandrel teeth with the thin-walled sleeve of the workpiece therebetween so as to thereby form the workpiece sleeve by the die and mandrel teeth.

5. In a forming machine including upper and lower bases defining a work space therebetween and a connecting portion that extends between the bases, a pair of elongated die racks respectively mounted on the upper and lower bases for rectilinear movement between an end-to-end relationship and an overlapping relationship, each die rack having a toothed forming face that opposes the forming face of the other die rack upon movement into the overlapping relationship, and a toothed mandrel that is rotatably mounted to receive and rotatably support a thin-walled annular sleeve of a workpiece between the die racks for forming of the sleeve upon movement of the die racks from the end-to-end relationship into the overlapping relationship, a rotary drive mechanism for the die racks comprising: a pair of elongated drive members respectively mounted on the upper and lower bases for rectilinear movement with the pair of elongated die racks; each drive member having drive teeth spaced along the elongated length thereof; a toothed drive gear rotatably supported coaxial with the mandrel and meshed with the drive teeth on both of the drive members; and a rotary drive spindle directly coupled to the drive gear to move the drive members and the die racks under the impetus of driving torque transmitted through the drive gear to mesh the die rack and mandrel teeth with the thin-walled sleeve of the workpiece located therebetween so as to thereby form the workpiece sleeve by the die rack and mandrel teeth.

6. In a forming machine including upper and lower bases defining a workspace therebetween and a connecting portion that extends between the bases, a pair of elongated die racks respectively mounted on the upper and lower bases for rectilinear movement between an end-to-end relationship and an overlapping relationship, each die rack having a toothed forming face that opposes the forming face of the other die rack upon movement into the overlapping relationship, and a toothed mandrel that is rotatably mounted to receive and rotatably support a thin-walled annular sleeve of a workpiece between the die racks for forming of the sleeve upon movement of the die racks from the end-to-end relationship into the overlapping relationship, a rotary drive mechanism for the die racks comprising: a pair of elongated drive members respectively mounted on the upper and lower bases for rectilinear movement with the pair of elongated die racks; each drive member having drive teeth spaced along the elongated length thereof; a toothed drive gear rotatably supported coaxial with the mandrel and meshed with the drive teeth on each of the drive members; a rotary drive spindle rotatively fixed to the drive gear; a gear reduction unit having an input and also having an output that rotatively drives the drive spindle; and a rotary drive motor that rotatively drives the input of the gear reduction unit to move the drive members and hence the die racks in order to mesh the die rack and mandrel teeth with the thin-walled sleeve of the workpiece located therebetween so as to thereby form the workpiece sleeve by the die rack and mandrel teeth.

7. In a forming machine including upper and lower bases defining a work space therebetween and a connecting portion that extends between the bases, a pair of elongated die racks respectively mounted on the upper and lower bases for rectilinear movement between an end-to-end relationship and an overlapping relationship, each die rack having a toothed forming face that opposes the forming face of the other die rack upon movement into the overlapping relationship, and a toothed mandrel that is rotatably mounted to receive and rotatably support a thin-walled annular sleeve of a workpiece between the die racks for forming of the sleeve upon movement of the die racks from the end-to-end relationship into the overlapping relationship, a rotary drive mechanism for the die racks comprising: a pair of elongated drive members respectively mounted on the upper and lower bases for rectilinear movement with the pair of elongated die racks; each drive member having drive teeth spaced along the elongated length thereof; a toothed drive gear rotatably supported coaxial with the mandrel and meshed with the drive teeth on each of the drive members; the drive gear and mandrel having associated central openings aligned with each other along the axis of mandrel rotation; a rotary drive spindle having an elongated shape with a central opening therethrough along the axis of mandrel rotation; the drive spindle having a driven end and also having a driving end that drives the drive gear; a gear reduction unit having an input and also having an output that rotatively drives the driven end of the drive spindle to move the drive members and hence the die racks in order to mesh the die rack and mandrel teeth with the thin-walled sleeve of the workpiece located therebetween so as to thereby form the workpiece sleeve by the die rack and mandrel teeth; and a loader including an axially movable unloading member that extends through the central openings of the drive gear, the mandrel, and the drive spindle.

* * * * *